US006709200B1

(12) United States Patent
Reynolds

(10) Patent No.: US 6,709,200 B1
(45) Date of Patent: Mar. 23, 2004

(54) METHOD OF CONSTRUCTING THE FOUNDATION AND SUPPORT STRUCTURE FOR ELEVATED TRANSPORTATION SYSTEMS

(76) Inventor: Milton Reynolds, 10912 Montrose Ave., Tampa, FL (US) 33617

( * ) Notice: Subject to any disclaimer, the term of this patent is extended or adjusted under 35 U.S.C. 154(b) by 0 days.

(21) Appl. No.: 10/285,863

(22) Filed: Nov. 1, 2002

(51) Int. Cl.[7] ..... E02D 27/12; E02D 5/30

(52) U.S. Cl. ..... 405/239; 405/257; 405/249; 405/233

(58) Field of Search ..... 405/231, 232, 405/233, 236, 239, 241, 242, 244, 249, 256, 257; 104/124, 125

(56) References Cited

U.S. PATENT DOCUMENTS 3,864,923 A * 2/1975 Turzillo ..... 405/238
3,869,003 A * 3/1975 Yamada et al. ..... 405/232
4,202,416 A * 5/1980 Blaschke et al. ..... 405/232
4,637,758 A * 1/1987 Tamaki et al. ..... 405/248
5,137,394 A * 8/1992 Tateno et al. ..... 405/232
5,419,658 A * 5/1995 DeWitt ..... 405/257
5,610,818 A * 3/1997 Ackroyd et al. ..... 455/456
6,394,704 B1 * 5/2002 Saeki et al. ..... 405/252.1

* cited by examiner

*Primary Examiner*—Frederick L. Lagman
(74) *Attorney, Agent, or Firm*—Dennis L. Cook, Esq.; Fowler White Boggs Banker P.A.

(57) ABSTRACT

A method for constructing the foundation and support structure for an elevated transportation system, such as an elevated guideway for use in a light rail mass transit system. In particular, this invention discloses a method of constructing a tubular steel or other material-encased concrete foundation pile that also functions as a support pier. The method utilizes advanced surveying, mapping, and global satellite positioning for locating and constructing the monolithic foundation and support pier, thereby resulting in greater efficiencies and cost savings than traditional construction methods.

16 Claims, 3 Drawing Sheets

METHOD OF CONSTRUCTING THE FOUNDATION AND SUPPORT STRUCTURE FOR ELEVATED TRANSPORTATION SYSTEMS

FIELD OF THE INVENTION

The present invention relates generally to a method of constructing the foundation piles and support structure for an elevated transportation system such as an elevated guideway for use in a light rail mass transit system. In particular, this invention discloses a method of constructing a tubular steel or other material-encased concrete pile that also functions as the support pier, such method utilizing advanced surveying, mapping, and global satellite positioning for equipment location and pile sinking construction methods, thereby resulting in greater efficiencies and cost savings than traditional construction methods.

BACKGROUND OF THE INVENTION

Roadway congestion has become a major problem in many metropolitan cities. According to one study, there will be 60 million to 77 million more vehicles on our roads by 2020; this is a 30 to 38 percent increase from 1995. Expansion of existing or construction of new roadways is often infeasible due to the scarcity of land and the high cost of construction.

The public has grown increasingly concerned about the impact of cars on the environment and the quality of life in urban areas, leading to increased support for the development of more efficient and comfortable mass transit systems. As an alternative to ground roadway construction, an elevated mass transportation system, such as a light rail transportation system, can often be built in existing right-of-way. Where feasible, utilizing existing right-of-way results in better land use and reduced land acquisition costs.

However, conventional construction methods for building the substructure of the system, in particular the supporting piers and foundations, is cost-prohibitive for constructing long-length elevated transportation systems. Where soil conditions necessitate a deep foundation, a columnar element or pile is inserted into the soil to transfer the load from the superstructure to the ground. This requires performing a site survey and layout, boring the hole, filling it with concrete, or alternatively driving a steel column into the ground to then be filled with concrete, and constructing a concrete cap on the pile. Subsequently, a concrete support element or pier is constructed on top of and fastened to the capped pile after it has cured to elevate the superstructure. This requires building a mold for the pier, placing steel reinforcements within the mold, filling the mold with concrete, and then, after the pier has cured, removing the mold.

This conventional construction method requires survey crews, engineers, heavy boring or pile driving equipment, concrete mixing equipment, equipment operators, and laborers. By constructing the pile and pier in two separate steps, such equipment and personnel have to be on the job site for a much longer time than if a single, monolithic pile foundation/pier structure is constructed. Further, utilizing conventional survey methods and equipment for pile and pier placement also results in the costly use of manpower for the duration of the job.

Steel-encased concrete piles and concrete pier support structures are well known in the art of bridge construction. Prior art discloses any number of patents for improvements in particular isolated construction methods. U.S. Pat. No. 3,779,025 by Godley and Kruse discloses a method for constructing a steel-encased concrete pile, whereby thin-walled pipe is driven by heavy equipment into the soil to penetration refusal and the pipe is filled with concrete. After the concrete cures, the pipe is driven further into the ground, another section of pipe is added, and the process repeated until the desired depth is obtained.

U.S. Pat. No. 3,938,344 by Asayama discloses an apparatus and method for driving steel-encased concrete piles using an auger projecting from the leading edge of the steel pipe to drill the pile into place and excavate the dirt and then fill the bore with concrete.

International Patent, Publication No. WO95/19576, Classification No. G01S 5/14, 5/02 discloses an apparatus and method for positioning construction equipment having a mast, such as a pile driver, using satellite navigation. Further, U.S. Pat. No. 5,610,818 by Ackroyd, et al. discloses a remotely operated computer system for navigating and positioning a piling rig and for driving the pile to the required depth while monitoring vertical tilt and maintaining vertical plumb.

Other patents, such as U.S. Pat. No. 4,087,220 by Koss, attempt to deal with the logistics and expense of constructing concrete pier support structures. Koss discloses an apparatus that provides for the sequential production of concrete bridge piers utilizing a girder system for movement and placement of the concrete pier forms with the object of reducing the amount of concrete pouring equipment and number of laborers on the jobsite.

The present invention discloses a method that overcomes the disadvantages of expense and time in constructing separate pile, cap, and pier structures and that realizes other efficiencies in construction methods by using advanced technology for equipment positioning and pile sinking technique.

BRIEF SUMMARY OF THE INVENTION

The method of the present invention can reduce the time and expense involved in conventional construction methods used in constructing the foundation and support structure for an elevated transportation system such as an elevated guideway for use in a light rail mass transit system. The present invention addresses construction of a monolithic tubular steel or other material-encased concrete structure serving as both a foundation pile and support pier.

The present invention utilizes advanced technology in equipment positioning and pile sinking construction methods. A pile sinking machine apparatus known to those skilled in the art is equipped with state-of-the-art digitized mapping and computer global satellite positioning technology for navigation and pile placement, such as the invention disclosed by Ackroyd, et al. in U.S. Pat. No. 5,610,818. The path of the elevated transportation system is defined and location of the foundation piles determined utilizing the digitized mapping technology. The pile sinking machine is navigated to the target location for the foundation piles utilizing the global positioning equipment.

Depending on the environmental and soil conditions, the appropriate pile sinking technique, including but not limited to percussion, vibration, drilling, or water jetting, will be used to sink a hollow steel or other material tubular casing to the proper bearing depth for the given superstructure. Either before or after the casing has been sunk, the soil will be removed from the ground in the proximity of the foundation piles placement with an auger or other excavation or drilling apparatus so as to maintain the hollow nature of the casing. One possible method is to use an auger to remove the soil approximating the casing's diameter to the proper bearing depth and then sinking the casing. Another method is to use an auger to assist in advancing the casing into the ground, and then use the auger to remove the dirt from within the casing by withdrawing the auger, as is contemplated by Asayama's U.S. Pat. No. 3,938,344. Alternatively, the pile can be sunk first, with then an auger used to remove the soil from the interior of the casing.

The pile sinking machine utilizes computerized depth and tilt measurement equipment to sink said casing to the necessary load bearing depth and achieve vertical plumb. The tubular casing will be of sufficient height such that a portion will remain above ground reaching the necessary elevation to support the structure's decking, the structure thus serving the dual role of a deep foundation as well as the support pier for the elevated transportation system. The tubular casing will then be filled with concrete and, if necessary, steel reinforcement (rebars) and steel ties. If required, the casing can be field-cut to the desired elevation either before or after filling the casing with concrete.

It is an object of the present invention to provide a method of construction for constructing the foundation piles and support structure for an elevated transportation system such as an elevated guideway for use in a light rail mass transit system.

It is an object of the present invention to utilize a monolithic tubular steel or other material-encased concrete structure to serve as both a foundation pile and support pier for the rest of the superstructure.

It an object of the present invention to provide a method of construction that results in cost savings and efficiencies by reducing the amount of time and resources required to construct a separate foundation pile and support pier.

It is an object of the present invention to use advanced surveying, mapping, and satellite positioning in the equipment location and pile sinking construction methods.

It should be appreciated that a number of configurations and alternative embodiments may be employed in the present invention, and that the invention is not limited to any particular machinery or equipment, pile sinking technique, or tubular casing material.

The accompanying drawings, which are incorporated in and constitute a part of this specification, together with the description, serve to explain the principles of the invention. The description of the preferred embodiment of this invention is given for purposes of explaining the principles thereof, and is not to be considered as limiting or restricting the invention since many modifications may be made by the exercise of skill in the art without departing from the scope of the invention.

DETAILED DESCRIPTION OF THE INVENTION

Figure 1:
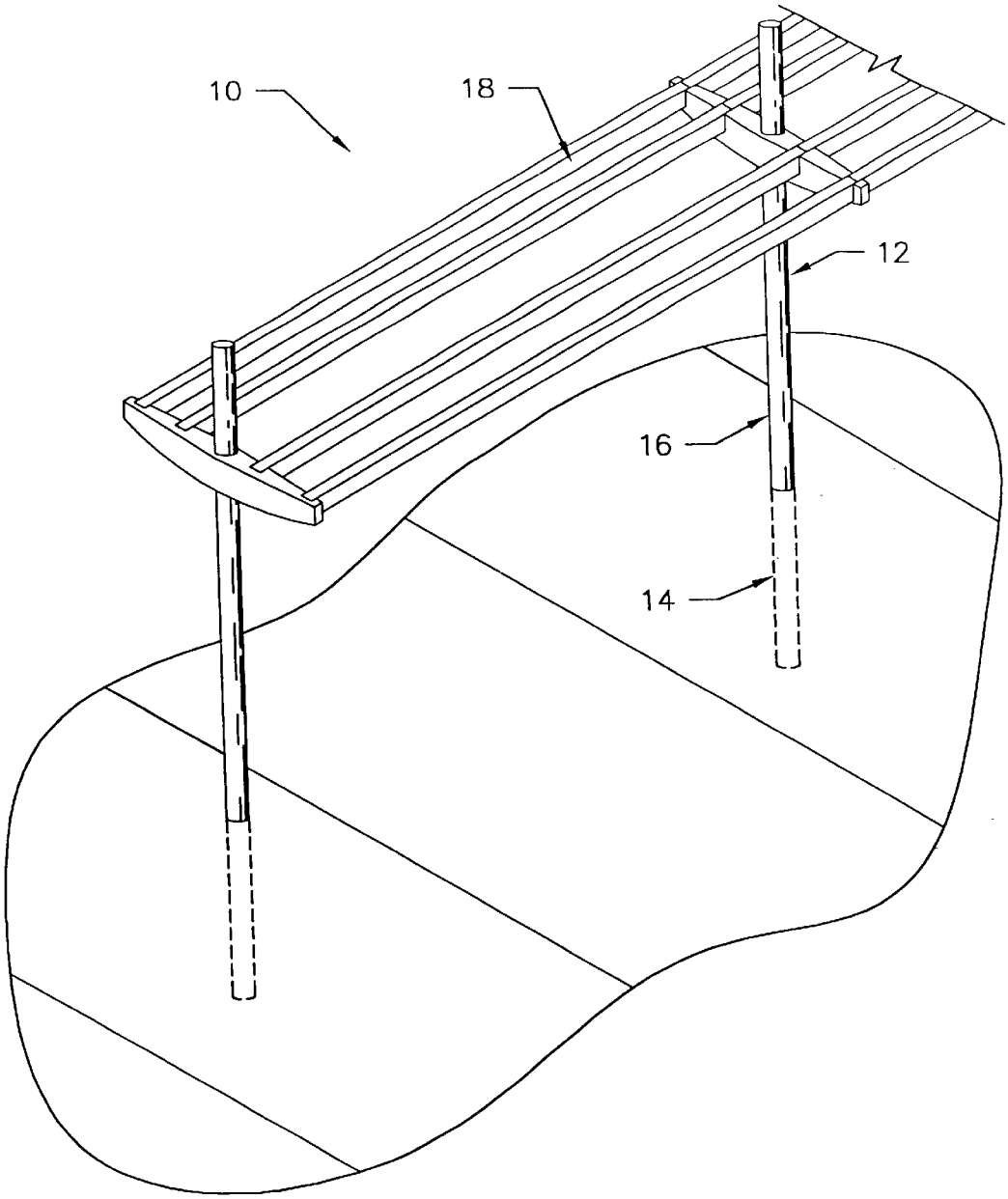
FIG. 1 is a perspective view of a longitudinal portion of an elevated transportation structure, such as a light rail guide way, incorporating the principle of a monolithic tubular steel or other material-encased concrete structure to serve as both a foundation pile and support pier for the rest of the superstructure.
Figure 2:
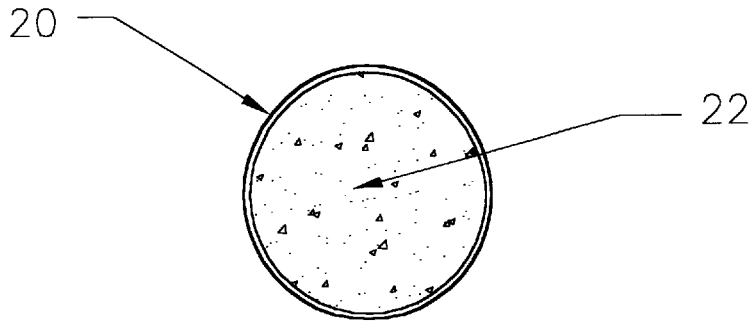
FIG. 2 is a cross-sectional top plan view of the monolithic foundation pile and support pier taken along Line A—A of FIG. 3.
Figure 3:
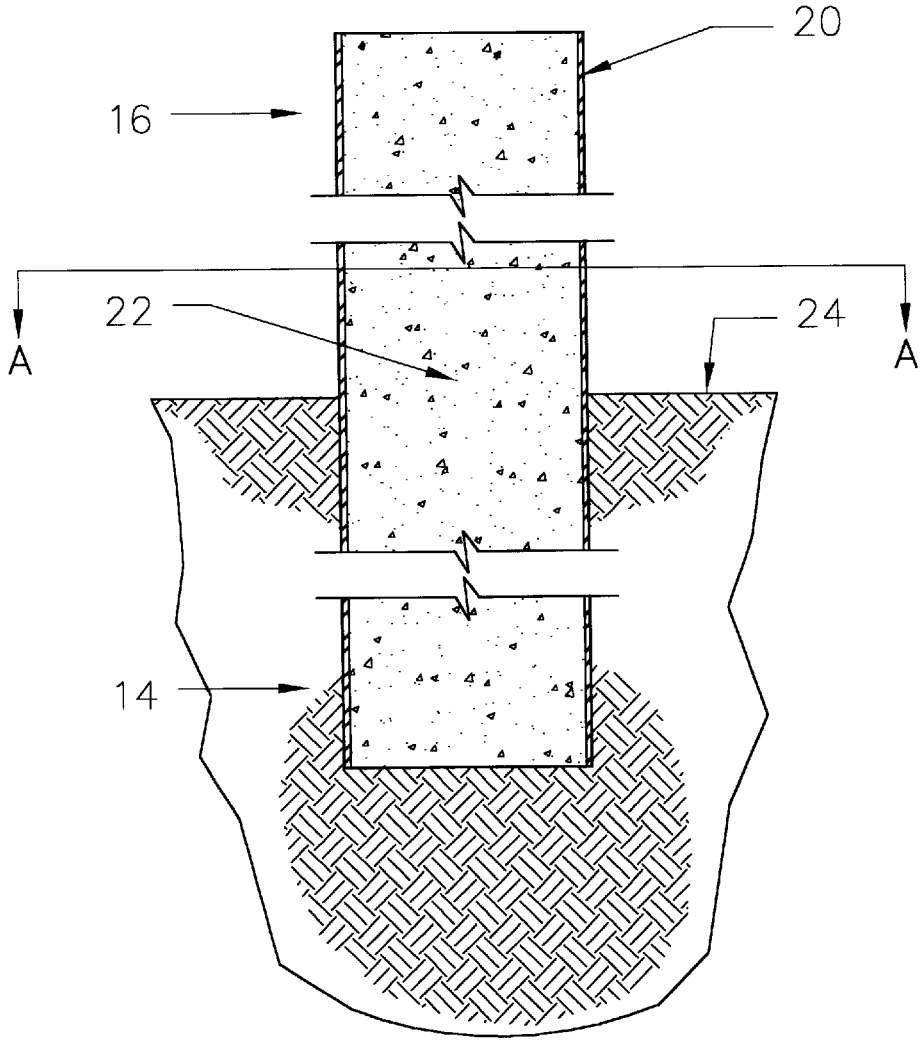
FIG. 3 is a vertically foreshortened cross-section elevation view of the monolithic foundation pile and support pier.
Figure 4:
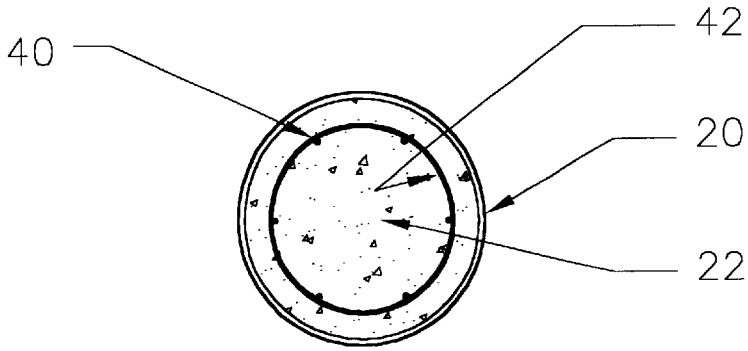
FIG. 4 is a cross-sectional top plan view of an alternate embodiment of the monolithic foundation pile and support pier shown in FIG. 3 taken along Line B—B of FIG. 5.
Figure 5:
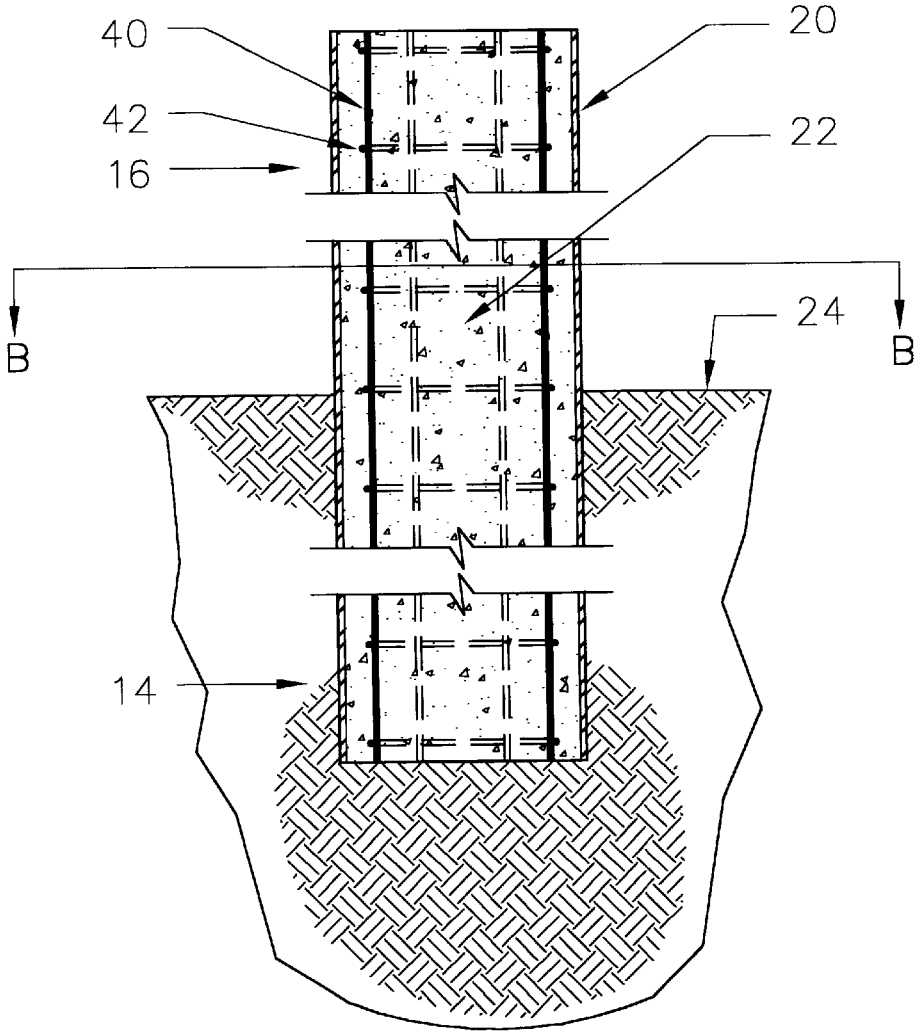
FIG. 5 is a vertically foreshortened cross-section elevation view of an alternative embodiment of FIG. 3, showing the monolithic foundation pile and support pier utilizing reinforced steel (rebars) and steel ties.

Referencing FIG. 1, the method of the present invention can reduce the time and expense involved in conventional construction methods used in constructing the foundation piles and support structure for an elevated transportation structure 10 for use in a light rail mass transit system such as an elevated guideway as depicted in a simplified cut-away perspective view in FIG. 1. The present invention addresses construction of a monolithic tubular steel or other material-encased concrete structure 12 serving as both a foundation pile 14 and support pier 16 for the deck beam members 18 and the rest of the superstructure.

The present invention utilizes advanced technology in equipment positioning and pile sinking construction methods. A pile sinking machine apparatus known to those skilled in the art is equipped with state-of-the-art digitized mapping and computer global satellite positioning technology for navigation and pile placement, such as the invention disclosed by Ackroyd, et al. in U.S. Pat. No. 5,610,818. The path of the elevated transportation system is defined and location of the foundation piles 14 determined utilizing the digitized mapping technology. The pile sinking machine is navigated to the target location for the foundation piles 14 utilizing the global positioning equipment.

Referencing FIG. 2 through FIG. 5, depending on the environmental and soil conditions, the appropriate pile sinking technique, including but not limited to percussion, vibration, drilling, or water jetting, will be used to sink a hollow steel or other material tubular casing 20 into the ground 24 to the proper load bearing depth for the given superstructure.

Either before or after the casing 20 has been sunk, the soil will be removed from the ground in the proximity of the foundation piles placement with an auger or other excavation or drilling apparatus so as to maintain the hollow nature of the casing 20. One possible method is to use an auger to remove the soil approximating the casing's 20 diameter to the proper bearing depth and then sinking the casing 20. Another method is to use an auger to assist in advancing the casing 20 into the ground, and then use the auger to remove the dirt from within the casing by withdrawing the auger, as is contemplated by Asayama's U.S. Pat. No. 3,938,344. Alternatively, the casing 20 can be sunk first, with then an auger used to remove the soil from the interior of the casing 20.

The pile sinking machine utilizes computerized depth and tilt measurement equipment to sink said casing 20 to the necessary load bearing depth and achieve vertical plumb. The tubular casing 20 will be of sufficient height such that a portion will remain above ground 24 reaching the necessary elevation to support the structure's decking, the structure thus serving the dual role of a foundation pile 14 as well as the support pier 16 for the elevated transportation structure. The tubular casing 20 will then be filled with concrete 22 and, if necessary, longitudinal steel reinforcement (rebars) 40 and horizontal steel ties 42. If required, the casing 20 can be field-cut to the desired elevation either before or after filling the casing 20 with concrete 22.

What is claimed is:

1. A method of constructing monolithic combination foundation pile and supporting pier structure for an elevated transportation system, comprising the steps of:

defining the path for the elevated transportation structure;

locating the foundation placement for the foundation piles;

sinking hollow steel or other material tubular casing into the ground to the necessary load-bearing depth, said casing to be used as an integral part of said foundation piles and supporting pier structures, with said casing also extending above the ground to the desired supporting pier structure height;

either before or after sinking said casing, removing the soil from the ground in the proximity of the foundation piles placement so as to maintain the hollow nature of the casing;

filling said casing with concrete, thereby forming a monolithic combination foundation pile and supporting pier structure; and either before or after filling said casing with concrete, trimming said casing to the requisite above-ground elevation.

2. The method of claim 1 wherein said path is defined utilizing state-of-the-art digitized mapping equipment.

3. The method of claim 1 wherein said placement of the foundation piles is located utilizing said digitized mapping equipment.

4. The method of claim 3 wherein said step of locating the placement of the foundation piles further comprises the step of navigating a pile sinking machine apparatus to the target location utilizing said digitized mapping and state-of-the-art global positioning equipment.

5. The method of claim 4 wherein said pile sinking machine apparatus is equipped with said digitizing mapping and global positioning equipment and computerized depth and tilt measurement equipment.

6. The method of claim 1 wherein an auger or other excavation or drilling apparatus is used to remove the soil approximating said casing's diameter to the proper bearing depth and then sinking said casing.

7. The method of claim 4 wherein said casing is sunk into the ground by said pile sinking machine apparatus to the necessary load-bearing depth.

8. The method of claim 7 wherein said pile sinking machine apparatus further comprises an auger that is used to remove the soil from the interior of said casing.

9. The method of claim 7 wherein said pile sinking machine apparatus further comprises an auger that is inserted into said casing with the auger projecting from the leading edge of said casing, said auger drilling the ground and simultaneously advancing said casing to the necessary bearing depth.

10. The method of claim 9 wherein said auger is used to remove the dirt from within the casing by withdrawing said auger.

11. The method of claim 7 wherein said pile sinking machine apparatus utilizes said computerized depth and tilt measurement equipment to sink said casing to the necessary load bearing depth and achieve vertical plumb.

12. The method of claim 9 wherein said pile sinking machine apparatus utilizes said computerized depth and tilt measurement equipment to sink said casing to the necessary load bearing depth and achieve vertical plumb.

13. The method of claim 1 further comprising the step, prior to filling said casing with concrete, of placing reinforcing steel (rebars) and steel ties in said casing.

14. The method of claim 1 wherein said filled casing extends above-ground to a height sufficient for said filled casing to function as a combination foundation pile and supporting pier structure.

15. The method of claim 1 wherein said casing is marked for trimming to the requisite above-ground elevation utilizing computerized surveying technology.

16. A method of constructing a monolithic combination foundation pile and supporting pier structure for an elevated transportation system, comprising the steps of defining the path for the elevated transportation structure utilizing state-of-the-art digitized mapping equipment; locating the placement for the foundation piles by utilizing said digitized mapping equipment; navigating a pile sinking machine apparatus to the target location, said machine apparatus equipped with and utilizing said digitized mapping and global positioning equipment, and said machine further equipped with computerized depth and tilt measurement equipment; sinking hollow steel or other material tubular casing into the ground to the necessary load-bearing depth and vertical plumb utilizing said depth measurement and tilt measurement equipment, said casing to be used as an integral part of said foundation piles and supporting pier structures, with said casing also extending above the ground to the desired supporting pier structure height; either before or after said casing has been sunk, removing the soil from the ground in the proximity of the foundation pile placement with an auger or other excavation or drilling apparatus so as to maintain the hollow nature of the casing; placing reinforcing steel (rebars) and steel ties in said casing, filling said casing with concrete, thereby forming a monolithic combination foundation pile and supporting pier structure; and either before or after filling said casing with concrete, marking said casing utilizing computerized surveying technology and trimming said casing to the requisite above-ground elevation.

* * * * *